United States Patent [19]

Parke

[11] 4,250,484

[45] Feb. 10, 1981

[54] ALARM SYSTEM FOR DETECTING A PLURALITY OF DIFFERENT ALARM CONDITIONS

[75] Inventor: Harry G. Parke, Brooklyn, N.Y.

[73] Assignee: Marine Electric Corporation, Brooklyn, N.Y.

[21] Appl. No.: 853,208

[22] Filed: Nov. 21, 1977

[51] Int. Cl.[3] ..... G08B 19/00

[52] U.S. Cl. ..... 340/52 F; 340/521; 340/533

[58] Field of Search ..... 340/52 F, 53, 288, 310 R, 340/531, 533, 517, 521, 652; 325/308

[56] References Cited

U.S. PATENT DOCUMENTS

| | | | |
|---|---|---|---|
| 3,797,008 | 3/1974 | Yuasa | 340/652 |
| 3,949,358 | 4/1976 | Higashi | 340/52 F |
| 4,114,150 | 9/1978 | Yamazaki et al. | 340/531 |

*Primary Examiner*—Alvin H. Waring
*Attorney, Agent, or Firm*—James L. Bean

[57] ABSTRACT

An alarm system, particularly for use on a train, responsive to a plurality of different alarm conditions for providing outputs for indicating which one or ones of the alarm conditions have been detected. A signal having at least as many frequency components as there are alarm conditions is generated on a transmission line which runs the length of the area over which the conditions are to be detected. Alarm sensing switches are connected to taps of the transmission line, and each switch is connected to a frequency dependent impedance means which is resonant and has a low impedance at one of the frequencies. A filter is provided for each alarm condition to be detected, each such filter having a band pass at one of said resonant frequencies. The presence of an alarm condition causes an alarm switch to change state, which causes one of the impedance means to short circuit a frequency which otherwise would have been passed by one of the filters, thus indicating the presence of an alarm condition.

15 Claims, 6 Drawing Figures

ALARM SYSTEM FOR DETECTING A PLURALITY OF DIFFERENT ALARM CONDITIONS

The present invention is directed to an alarm system, and more particularly, to an alarm system which is responsive to a plurality of different alarm conditions for indicating which one or ones of the alarm conditions is present.

Although not limited thereto, the alarm system of the present invention finds particular use as an on-board surveillance system for trains. To be effective, any practical train alarm system must simultaneously monitor several alarm conditions, and typically, the bearings, brakes and air springs of each car of the train should be monitored. Since different alarm conditions will require different responses on the part of the engineer, it is necessary for the alarm system to provide an indication of the type of alarm condition which exists. For instance, an overheated bearing almost always requires an immediate stop since there is danger that a derailment will occur very shortly. On the other hand, while overheated brakes present a fire danger, the danger is not immediate, so that a convenient stopping place may be sought. A deflated air spring does not require a stop but merely requires that the train be operated at lower speeds around curves.

Additionally, in a train alarm system, it is desirable to utilize only a single transmission line which runs the length of the train for the transmission of all alarm information. It is further required that the alarm system be fail-safe, since a circuit failure which is not picked up and which prevents proper operation of the alarm system could result in the loss of people's lives.

It is therefore an object of the invention to provide an alarm system which is simultaneously responsive to a plurality of alarm conditions and which provides an indication of the type of alarm condition which is detected.

It is a further object to provide such an alarm system which utilizes only a single transmission line for the transmission of alarm data.

It is still a further object of the invention to provide an alarm system which is fail-safe and which generates an alarm output responsive to circuit failures such as shorts, open circuits and loss of signal.

It is a further object of the invention to provide a useful and effective alarm system for a train.

The above objects are accomplished by providing a resistor terminated transmission line which extends to all of the general areas at which it is desired to detect alarm conditions; for example, in a train the transmission line would run the length of the train and would be tapped at various points, for instance, near the wheels, for connection to alarm condition sensing switch means. A signal having at least as many frequency components as alarm conditions which it is desired to detect is generated and is transmitted down the transmission line. A plurality of groups of alarm sensing switch means are provided, the switch means which make up each group being responsive to the same alarm condition but being connected to the transmission line at different locations or tap offs. A plurality of filter means are provided, each filter means being arranged to pass a different one of the generated frequency components, and a different filter means is associated with each group of switch means.

Each switch means in the same group is connected to a frequency dependent variable impedance means which has a low impedance at the frequency which is passed by the filter means which is associated with that group. The circuit is arranged so that when a switch means closes in response to the occurrence of an alarm condition, the low impedance is connected across the filter means, thereby shunting the frequency normally passed by the filter, the signal actually passed during shunting being significantly attenuated. The attenuated signal is sensed and operates an alarm output means, which provides an indication of which one of the alarm conditions has been detected.

The invention will be better understood by referring to the accompanying drawings, in which.

Figure 1:
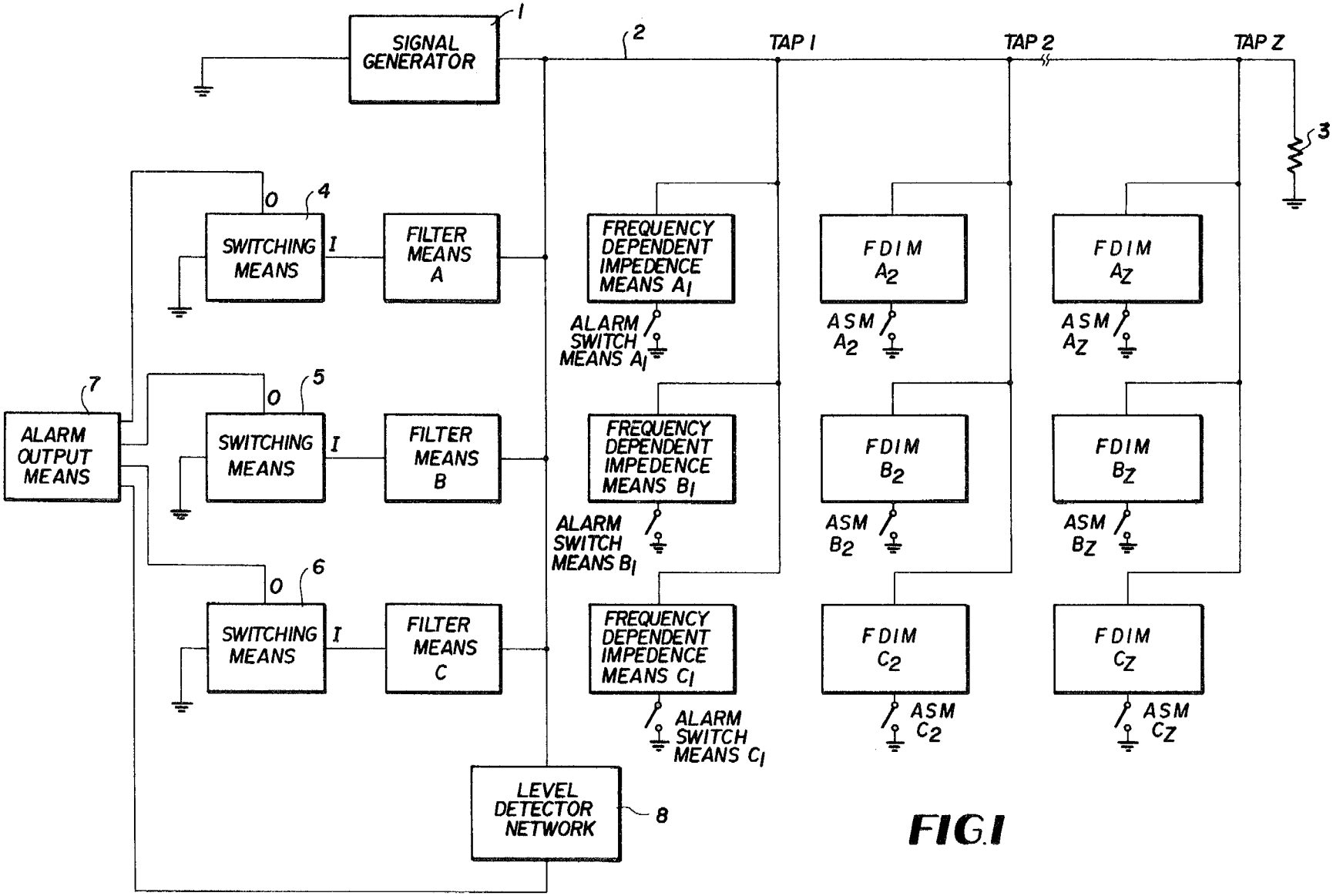
FIG. 1 is a circuit diagram of an embodiment of the alarm system of the invention in block form.
Figure 2:
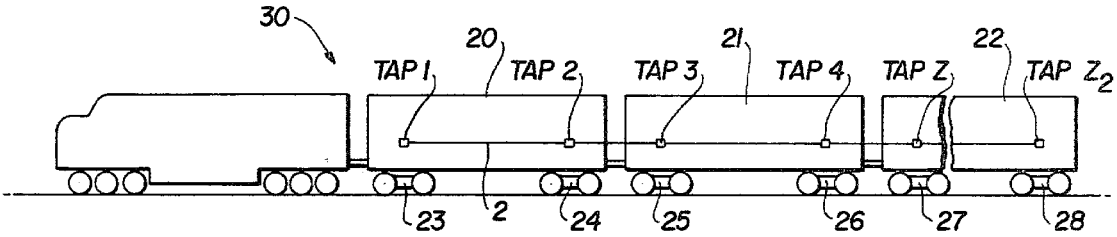
FIG. 2 is a pictorial representation of a train, showing alarm transmission line 2 which runs the length of the train.

Referring to FIG. 1, it is desired to detect a plurality of different alarm conditions which shall be referred to as alarm conditions A, B and C, respectively, and to transmit the alarm information to an alarm output means 7. For instance, if the system is utilized in a train, then conditions A, B and C might be overheated bearings, overheated brakes, and deflated air springs, respectively. As will be appreciated, it may be necessary to detect the same condition at a plurality of different locations, and in the case of a train, these locations will be more or less longitudinally displaced along the length of the train. An alarm condition sensing switch means is located at each alarm detection location, and in FIG. 1, switch means $A_1$, $A_2$ and $A_z$ detect alarm condition A at locations 1, 2 and z respectively, switch means $B_1$, $B_2$ and $B_z$ detect alarm condition B at locations 1, 2 and z respectively, and switch means $C_1$, $C_2$ and $C_z$ detect alarm condition C at locations 1, 2 and z respectively. This is pictorially shown for the case of a train in FIG. 2 wherein it is seen that train 30 includes cars 20, 21 and 22, and transmission line 2 runs the length of the train. The transmission line is tapped proximate the position of each wheel pair or other sensing location for connection to the alarm condition sensing switch means. It should be understood that while the embodiment of FIG. 1 is illustrated as having three (3) groups of switch means, in actual practice, any desired number of groups may be used.

The specific structure of the various alarm condition sensing switch means is known and is not a part of the present invention. For example, there are many known types of hot box detectors which may be used to detect overheated bearings, and similarly, other types of known networks may be used to detect the other alarm conditions. The salient characteristic of each alarm condition sensing switch means is that it changes state when the alarm condition to which it is responsive is detected.

Figure 5:
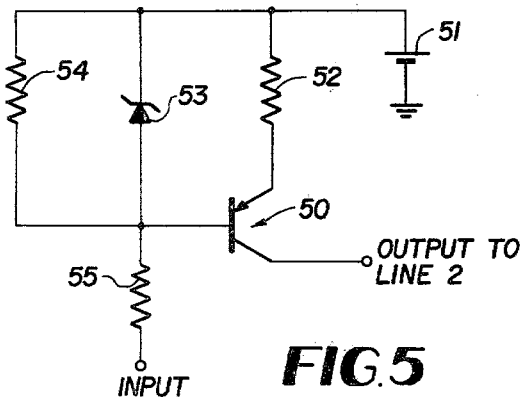
FIG. 5 is a schematic diagram of a preferred embodiment of current generator 1, shown in FIG. 1.

Referring to FIG. 1, transmission line 2 is terminated at the end thereof by resistor 3. Signal generator 1 is a means for generating a signal having at least as many frequency components as there are alarm conditions to be detected. Each frequency component corresponds to a resepective alarm condition, and the signal generated by generator 1 is fed to line 2 for transmission therealong. According to the invention, instead of using separate generating means or frequency division schemes, signal generator 1 is a means for generating a non-sinusoidal periodic function, the Fourier series of which includes the desired sinusoidal frequency components. Thus, the advantages of separate sinusoidal signals are achieved at a lower cost. In the preferred embodiment of the invention, signal generator 1 is a current generator, and a schematic diagram of such a generator is shown in FIG. 5.

A plurality of band pass filter means, each for passing a frequency component generated by signal generator 1 are provided and are connected in parallel across the signal generator at the signal generator side of the transmission line. Referring to FIG. 1, filter means A corresponds to alarm condition A, and passes the frequency component which corresponds thereto, filter means B corresponds to alarm condition B and passes the frequency which corresponds thereto, and filter means C corresponds to alarm condition C and passes the frequency which corresponds thereto. Assuming that there is no alarm condition present, and that all of the alarm switch means are in the open state, current at frequencies A, B and C will flow respectively through filter means A, B and C, and will flow through switching means 4, 5 and 6, to ground. Each of switching means 4, 5 and 6 is a network which is designed so that no signal is present at the output O so long as a signal above a predetermined level is present at the input I. The exact structure of such a network is within the skill of one in the art, and it may, for instance, be a solid state network, or alternatively, a normally closed relay, the coil of which is connected between the filter and ground, and the contacts being held open by a normal output level from the filters but closing when the level falls beneath a predetermined value.

Figure 3:
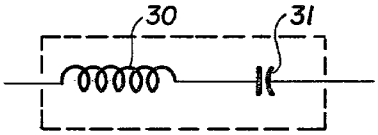
FIG. 3 is a schematic diagram of a tuned circuit, which in the preferred embodiment of the invention is utilized for the frequency dependent impedance means shown in FIG. 1.

Each alarm switch means is connected in series with a frequency dependent impedence means, and the series combination is connected between ground and a tap of the transmission line. The frequency dependent impedence means have a low impedance at a particular resonant frequency, (or narrow frequency range), and a significantly higher impedance at other frequencies. In FIG. 1, each of the A impedance means are resonant at the frequency passed by filter means A, each of the B impedance means are resonant at the frequency passed by filter means B, and each of the C impedance means are resonant at the frequency passed by filter means C. In the preferred embodiment of the invention, the frequency dependent impedance means are series tuned circuits, such as the circuit shown in FIG. 3 which is comprised of inductor 30 and capacitor 31. However, it should be understood that other impedance means may be used, and the term frequency dependent impedance means is to be constructed as covering means both presently known and which may be discovered in the future having the impedance characteristic described. Also, while the embodiment of FIG. 1 shows each alarm switch means connected to a separate frequency dependent impedance means, it would be possible to connect all of the switch means of each group to the same impedance means, although such an arrangement would necessitate the use of additional conductors running the length of the train, which might not be desirable.

As long as no alarm condition is present and all of the alarm switch means are open, none of the impedance means are connected in the circuit. However, when an alarm switch means closes, it connects the impedence means which it is in series with, in parallel with all of the filter means, which effectively shunts the particular filter means which has its band pass at the resonant frequency of the impedance means. For example, if one of the A switch means closes, then filter means A becomes shunted, and the current input to switching means 4 is attenuated sufficiently for a signal to appear at output O of unit 4. Alarm output means 7 is a means which is responsive to the presence of an input signal for producing alarm output indications. For instance, output means 7 may be merely a plurality of indicator lamps, each one of which is connected to one of the inputs to unit 7 for lighting up when the respective alarm condition is triggered. If desired, output means 7 may include an additional common output indicator, such as a bell, which generates an output if any of the alarm conditions is detected. In such an arrangement, the inputs could be connected to the common indicator by conventional logic means, such as an OR gate.

As mentioned above, it is extremely important that the alarm system be fail safe, and that it indicate an alarm condition in the event that part of the circuit fails. The embodiment of FIG. 1 is inherently fail safe for the situations of loss of signal from generator 1 and short circuit of transmission line 2 to ground. In both of these cases, all of the frequencies will vanish, and the alarm output means 7 will be activated.

Fail safe against open circuiting of transmission line 2 is provided by level detector network 8. Assuming signal generator 1 to be a current generator, a voltage equal to the current generated by the generator times the resistance of resistor 3 exists across resistor 3. If transmission line 2 opens at any point, the current generator no longer sees the resistance of resistor 3, but rather sees the substantially infinite resistance of an open circuit. The voltage on the transmission line will therefore rise to the open circuit voltage of current generator 1 which is significantly higher than the voltage on line 2 when there is no open circuit. Level detector network 8 is operative to detect this rise in voltage, and to trigger alarm output means 7.

Figure 4:
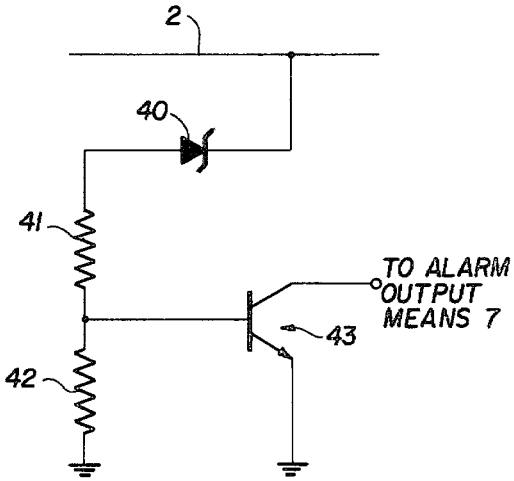
FIG. 4 is a schematic diagram of a preferred embodiment of voltage level detector 8, shown in FIG. 1.

A preferred embodiment of level detector network 8 is shown in FIG. 4. The heart of the level detector is zener diode 40, the breakdown voltage of which is higher than the voltage on line 2 when there is no open circuit, but lower than the voltage on line 2 when an open circuit exists. Zener diode 40 is connected to the base of transistor 43 through resistor 41, and alarm output means 7 is connected to the collector of the transistor. The circuit is arranged to hold transistor 43 in the off or non-conducting state when the zener diode is an effective open circuit. When the breakdown voltage of the zener diode is exceeded, base current is delivered to the transistor through resistor 41, thereby turning the transistor on, and activating alarm output means 7.

While it is possible to use many different types of current generators in the circuit of FIG. 1, a preferred embodiment of a current generator for use in this circuit is shown in FIG. 5. A PNP power transistor 50 is provided, and the series combination of resistor 52 and the parallel combination of zener diode 53 and resistor 54 are connected in the emitter-base circuit. The emitter is connected to power source 51 through resistor 52, an input resistor 55 is connected from the base of the transistor to the input of the circuit, and the output of the circuit is at the collector of the transistor. When a negative pulse train is fed to the input of the circuit, a fixed current pulse train is delivered at the output.

The circuit is arranged so that resistor 54 holds the transistor cut off unless negative current is fed through resistor 55. When current of sufficient magnitude is fed into resistor 55, the base of transistor 50 drops to a fixed voltage below battery 51 (determined by zener diode 53), resulting in a fixed current which is determined primarily by the voltage drop of zener diode 53 and the resistance of resistor 52, being delivered from the collector of transistor 50 to transmission line 2.

Figure 6:
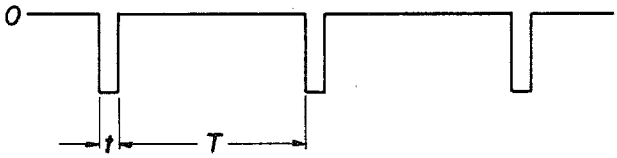
FIG. 6 shows a pulse waveform which may be utilized as the input to the circuit shown in FIG. 5.

The signal which is used to drive the input of the circuit of FIG. 5 is shown in FIG. 6, and is seen to be a periodic pulse waveform of widely spaced, narrow pulses. As is well known, such pulse waveforms contain almost equal levels of the fundamental and lowest harmonics. While the invention is illustrated using a rectangular pulse waveform, it should be understood that any periodic waveform, the Fourier series of which includes the desired frequency components, can be utilized.

In an actual illustrative embodiment of the invention, the current into transmission line 2 is ½ ampere, and a sixty ohm resistor is used for resistor 3 so that 30 volts peak is developed in the absence of an open circuit. If an open circuit does develop under these circumstances, then the voltage on line 2 rises to the open circuit voltage of the generator (60 volts), which would be high enough to break down zener diode 40 of FIG. 4. Referring to the waveform of FIG. 6, a period of 2000 microseconds is used, each pulse having a duration of 200 microseconds. This results in a fundamental of 500 hz, and first and second harmonics of 1,000 hz and 1,500 hz respectively. As indicated above, with the waveform shown, the fundamental and first and second harmonics are all large and are nearly equal.

It should be appreciated that while the invention finds its primary use as an alarm system, it is not limited thereto, and can be used in any application where it is necessary to monitor groups of switch means and to provide an indication of the group to which a switch means which has changed state belongs. For instance, the switch means instead of being alarm condition sensing switch means could be switches which are manually closed and opened, such as in a call system.

In interpreting the following claims, it should be understood that the singular includes the plural, and that while I have disclosed and described a specific embodiment of my invention, I do not intend to be limited solely thereto, but rather intend to embrace all subject matter which comes within the spirit and scope of the claims.

What is claimed:

1. An electrical system for detecting a change in state of a switch means which is in one of a plurality of groups of switch means and for providing an indication of the group to which the switch means which has changed state belongs, each group of switch means including one or more switch means, comprising, an electrical transmission line, means for generating a signal on said transmission line having a plurality of frequency components at least equal in number to the number of said groups of switch means, each frequency component corresponding to one of said groups, a plurality of filter means in circuit connection with said line, each filter means being associated with a different group and comprising a means for passing the frequency component corresponding to that group, a plurality of frequency dependent variable impedance means at least equal in number to the number of said groups, each said means being associated with a group and comprising a means responsive to the change in state of a switch means in that group for attenuating the frequency component which is passed by the filter means associated with that group, and means responsive to the attenuation of said frequency component beneath a predetermined level for providing an indication of the group corresponding to the attenuated frequency component which is the group which includes the switch means which has changed state.

2. The system of claim 1 wherein said electrical system is an alarm system and wherein each of said switch means comprises an alarm condition sensing switch means.

3. The system of claim 1 wherein said means for generating comprises means for generating a non-sinusoidal periodic signal, the Fourier series of which includes said plurality of frequency components.

4. The system of claim 2 wherein each of said groups of switch means includes a plurality of alarm condition sensing switch means and wherein all of said switch means of any one group sense the same alarm condition while the switch means of different groups sense different alarm conditions.

5. The system of claim 4 for detecting a set of different alarm conditions at each of a plurality of different general areas which are spaced along said transmission line, a set of switch means comprised of switch means from different ones of said groups being disposed at different locations within any one such general area, and the different means of any one of said groups being disposed at locations within different ones of said general areas.

6. The system of claim 5 wherein said transmission line is disposed along the length of a train which is made up of a plurality of cars, and wherein some of said sets of switch means are disposed at locations in different ones of said cars than others of said sets of switch means.

7. The system of claim 2 wherein said frequency dependent variable impedance means comprise tuned circuits which are resonant at the frequency corresponding to the group with which the impedance means is associated.

8. The system of claim 7 wherein each of said tuned circuits is in direct circuit connection with a said switch means.

9. The system of claim 8 wherein each of said tuned circuits is in series connection with only one of said switch means.

10. The system of claim 2 wherein said filter means are connected in parallel across said signal generating means, and wherein when an alarm condition is detected a said frequency dependent variable impedance means is also switched into parallel connection across said signal generating means by an alarm condition sensing switch means in the group with which the impedance means is associated, which attenuates the frequency component which is passed by the filter means associated with that group.

11. The system of claim 8 wherein said filter means are connected in parallel across said signal generating means, and wherein when an alarm condition is detected a said tuned circuit is also switched into parallel connection across said signal generating means.

12. The system of claim 2 wherein said signal generating means is a current generating means.

13. The system of claim 12 further including fail safe means for detecting if said transmission line becomes open circuited, said transmission line being terminated by a resistance means, and said fail safe means comprising voltage level detection means connected to the output of said current generating means for detecting when the voltage at said output rises above a predetermined level.

14. The system of claim 13 wherein said level detecting means includes a zener diode in circuit connection with a transistor.

15. The system of claim 4 wherein said means responsive to the attenuation of said frequency component comprises a plurality of switching means, each switching means being connected in series with one of said filter means.

* * * * *